US007674314B2

(12) United States Patent
Harada et al.

(10) Patent No.: US 7,674,314 B2
(45) Date of Patent: Mar. 9, 2010

(54) PROCESS FOR PRODUCING REDUCED METAL AND AGGLOMERATE WITH CARBONACEOUS MATERIAL INCORPORATED THEREIN

(75) Inventors: Takao Harada, Kobe (JP); Hidetoshi Tanaka, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 813 days.

(21) Appl. No.: 10/548,519

(22) PCT Filed: Mar. 9, 2004

(86) PCT No.: PCT/JP2004/001337

§ 371 (c)(1),
(2), (4) Date: Sep. 9, 2005

(87) PCT Pub. No.: WO2004/081238

PCT Pub. Date: Sep. 23, 2004

(65) Prior Publication Data

US 2006/0278040 A1 Dec. 14, 2006

(30) Foreign Application Priority Data

Mar. 10, 2003 (JP) ..... 2003-063516

(51) Int. Cl.
*C22B 1/16* (2006.01)
*C21B 13/08* (2006.01)

(52) U.S. Cl. ..... 75/320; 75/484; 75/766

(58) Field of Classification Search ..... 75/484, 75/485, 320, 766
See application file for complete search history.

(56) References Cited

U.S. PATENT DOCUMENTS

| | | | | | |
|---|---|---|---|---|---|
| 2,473,987 | A | * | 6/1949 | Brandon | 75/764 |
| 3,174,846 | A | * | 3/1965 | Brisse et al. | 75/762 |
| 3,383,199 | A | * | 5/1968 | Schmidt | 75/320 |
| 3,503,735 | A | * | 3/1970 | Vedensky et al. | 420/94 |
| 4,257,806 | A | * | 3/1981 | Fujita et al. | 75/471 |
| 4,601,749 | A | * | 7/1986 | Yamada et al. | 75/532 |
| 5,601,631 | A | | 2/1997 | Rinker et al. | |
| 5,865,875 | A | * | 2/1999 | Rinker et al. | 75/436 |
| 6,126,718 | A | * | 10/2000 | Sawa et al. | 75/485 |
| 6,129,777 | A | | 10/2000 | Fuji et al. | |
| 6,251,161 | B1 | | 6/2001 | Tateishi et al. | |
| 6,254,665 | B1 | | 7/2001 | Matsushita et al. | |
| 6,258,149 | B1 | | 7/2001 | Sugiyama et al. | |
| 6,319,302 | B1 | | 11/2001 | Harada | |
| 6,334,883 | B1 | | 1/2002 | Takenaka et al. | |
| 6,602,320 | B2 | * | 8/2003 | Fuji et al. | 75/484 |
| 6,811,759 | B2 | | 11/2004 | Tsuchiya et al. | |
| 6,921,427 | B2 | * | 7/2005 | Nayak et al. | 75/770 |
| 2003/0097908 | A1 | * | 5/2003 | Hoffman et al. | 75/484 |
| 2004/0083853 | A1 | | 5/2004 | Sugitatsu et al. | |
| 2004/0163493 | A1 | | 8/2004 | Harada et al. | |
| 2005/0028643 | A1 | | 2/2005 | Tanaka et al. | |
| 2005/0211020 | A1 | | 9/2005 | Sugitatsu et al. | |

FOREIGN PATENT DOCUMENTS

| | | | |
|---|---|---|---|
| JP | 74007697 | * | 3/1972 |
| JP | 58052445 A | * | 3/1983 |
| JP | 2001-294944 | | 10/2001 |
| JP | 2003-13125 | | 1/2003 |

OTHER PUBLICATIONS

Machine translation of Japanese patent document 2001-294944 into English.*
The Making of Steel, The American Iron and Steel Institute, 1954, p. 25.*
Written translation of JP 72007697, published Mar. 4, 1972.*

* cited by examiner

*Primary Examiner*—George Wyszomierski
*Assistant Examiner*—Tima M McGuthry-Banks
(74) *Attorney, Agent, or Firm*—Oblon, Spivak, McClelland, Maier & Neustadt, L.L.P.

(57) ABSTRACT

Agglomerates with a carbonaceous material incorporated therein and a process for producing reduced metal using the agglomerates are provided. The agglomerates are prepared with high-VM coal, which is widely and abundantly produced and is less expensive, and they provide high strength after reduction without the need for finer metal oxide particles. The agglomerates are made of a carbonaceous material and a raw material to be reduced that contains a metal oxide, such as iron ore. The carbonaceous material used is a high-VM coal containing 35% or more by mass of volatile matter. The agglomerates are formed at a pressure of at least 2 t/cm$^2$ so that the porosity thereof is reduced to 35% or less. The reduction in porosity is effective in promoting heat transfer inside the agglomerates in a rotary hearth furnace in a high-temperature reduction step so that the sintering of reduced metal proceeds efficiently in the overall regions of the agglomerates to produce a reduced metal having high crushing strength.

18 Claims, 3 Drawing Sheets

PROCESS FOR PRODUCING REDUCED METAL AND AGGLOMERATE WITH CARBONACEOUS MATERIAL INCORPORATED THEREIN

TECHNICAL FIELD

The present invention relates to processes for producing reduced metal with agglomerates with a carbonaceous material incorporated therein that are prepared by agglomerating a powdered mixture of metal oxide, such as iron ore, and coal. Specifically, the present invention relates to a process for producing a reduced metal having high crushing strength after reduction using a coal having a high volatile matter content, namely a high-VM coal, and also relates to agglomerates with a carbonaceous material incorporated therein for use in the above process.

BACKGROUND ART

According to a known process for producing reduced iron, fine ore or lump ore is reduced in the solid phase in a counter-flow shaft furnace using a reducing gas prepared by reforming natural gas to produce reduced iron. This process, however, requires a large supply of natural gas, which is expensive as a reducing agent, and generally has limitations such as plant siting limited to regions where natural gas is produced.

Accordingly, processes for producing reduced iron using coal as a reducing agent, instead of natural gas, have recently attracted attention. Coal is relatively less expensive and eases geographical limitations on plant siting. Such processes for producing reduced iron using coal as a reducing agent are exemplified by a known process described below. A raw material containing a metal oxide such as iron oxide is mixed with a carbonaceous material. The mixture is then dried and agglomerated under such conditions as to generate volatile matter. For the volatile matter to function as a binder, the dried mixture is heated and compressed to prepare green compacts. The green compacts are charged into a rotary hearth furnace and are reduced by heating at 2,150° F. to 2,350° F. (1,177° C. to 1,288° C.) for 5 to 12 minutes to produce reduced iron.

According to this process, if the content of the volatile matter, which functions as a binder, in the coal is less than 20% by mass, the green compacts require an additional organic binder. If the content of the volatile matter is 20% to 30% by mass, the green compacts require compression above 10,000 lb/in$^2$ (703 kg/cm$^2$) and heating at 800° F. (427° C.). If the content of the volatile matter exceeds 30% by mass, the green compacts only require compression above 10,000 lb/in$^2$ (703 kg/cm$^2$). The carbonaceous material used is preferably a coal having a high fixed carbon content and a volatile matter content of about 20% by mass or more, such as bituminous coal.

If the reduced iron discharged from the rotary hearth furnace has an excess carbon content of 2% to 10% by mass, the excess carbon advantageously increases the rate of reduction to promote complete reduction. In addition, the excess carbon may be utilized as carbon for steelmaking in an electric furnace.

Because the green compacts (hereinafter also referred to as agglomerates with the carbonaceous material incorporated therein) are porous, they have insufficient contact between the carbonaceous material and the metal oxide, such as iron ore, and thus exhibit low thermal conductivity and a low reduction rate. A process has been attempted in which a carbonaceous material that exhibits lower maximum fluidity in softening melting is used for the agglomerates with the carbonaceous material incorporated therein in combination with a higher content of fine iron oxide particles having a particle size of 10 μm or less in the metal oxide (namely, iron ore) to increase the number of contacts between the iron oxide particles. According to this process, even if the carbonaceous material exhibits lower maximum fluidity in softening melting, the contact area between the iron oxide particles can be increased to enhance the thermal conductivity inside the agglomerates with the carbonaceous material incorporated therein. This results in a larger number of contacts between particles metallized by heating reduction so that the sintering thereof is promoted to provide high-strength reducing iron.

If, however, a reduced iron containing about 2% to 10% by mass of residual carbon is produced at about 10,000 lb/in$^2$ (703 kg/cm$^2$), a carbonaceous material having a high fixed carbon content must be generally used for increasing the content of elemental iron to ensure sufficient reduced iron strength. The above process for producing reduced iron therefore seems to require a high-grade bituminous coal having a high fixed carbon content and a volatile matter content of up to 35% by mass.

Such a high-grade bituminous coal, which has high quality with a high fixed carbon content, poses the problem of high cost due to small reserves and limited sources. On the other hand, coals having low fixed carbon contents, including subbituminous coal and other ranks of coals with lower degrees of coalification than subbituminous coal, are potential raw materials for steelmaking because of large reserves, unlimited sources, and low cost. If, however, subbituminous coal, which has a low fixed carbon content, or a coal with a lower degree of coalification, such as lignite, is used, the mixing ratio of the carbonaceous material to iron oxide, namely iron ore powder, must be increased; fixed carbon contributes greatly to the reduction of metal oxide such as iron oxide.

An increase in the content of coal with a low degree of coalification results in a relative decrease in the content of elemental iron in a green compact. This decreases bonding strength due to, for example, sintering by reduction, and thus decreases the strength of reduced iron. A reduced iron with decreased strength powders on impact when, for example, discharged from a rotary hearth furnace with a discharger. The powdered reduced iron, which has an increased specific surface area, is readily reoxidized by contact with oxidizing gases such as carbon dioxide and steam in the rotary hearth furnace. The resultant reduced iron is therefore less valuable as a semi-finished product, and exhibits poor handling properties because of its powdered form. Unfortunately, additionally, the powdered reduced iron, which has low bulk density, cannot be melted in a melting furnace because the powder floats over a slag layer.

On the other hand, a decreased content of carbonaceous material with a low fixed carbon content provides higher reduced iron strength. In this case, however, a metal oxide such as iron oxide cannot be sufficiently reduced because of the insufficient content of fixed carbon contributing to the reduction. If, for example, a reduced iron having a low residual carbon content is melted to produce hot metal, a carbonaceous material must be added to the hot metal to achieve the required carbon content. The addition of carbon to the hot metal increases the consumption of carbonaceous material because of its low yield, and may fail to achieve a target carbon concentration.

According to the process in which the proportion of fine iron oxide particles with a particle size of 10 μm or less is increased, the content of fine iron oxide particles with a particle size of 10 μm or less must be increased as the maximum fluidity of carbonaceous material is decreased. This process requires an additional step for providing finer particles. The use of coarse iron oxide particles with a particle size exceeding 10 μm alone cannot provide reduced iron with high strength.

The present invention focuses on the above problems in the related art. An object of the present invention is to provide agglomerates with a carbonaceous material incorporated therein that are prepared with high-VM coal, which is widely and abundantly produced and is less expensive, and that can provide high-strength reduced metal without the use of finer metal oxide particles, and also provide a process for producing reduced metal using the agglomerates.

DISCLOSURE OF INVENTION

To achieve the above object, the present invention provides the following embodiments.

A process for producing reduced metal according to the present invention includes molding a carbonaceous material made of a high-VM coal containing 35% or more by mass of volatile matter and a raw material to be reduced that contains a metal oxide at 2 t/cm$^2$ or more to form agglomerates with the carbonaceous material incorporated therein; and heating the agglomerates with the carbonaceous material incorporated therein in a rotary hearth furnace to reduce the agglomerates at high temperature.

Coal with a relatively low degree of coalification which contains 35% by mass or more of volatile matter is widely and abundantly distributed throughout the world, and is therefore less expensive. Use of such coal reduces the cost of producing agglomerates with a carbonaceous material incorporated therein and eliminates the limitations on plant siting. In addition, the volatile matter contained in the high-VM coal may be used as a fuel for heating the agglomerates with the carbonaceous material incorporated therein in the rotary hearth furnace. The high-VM coal can therefore save fuel for supply to a burner. The agglomerates with the coal having a relatively low degree of coalification incorporated therein may be formed at a pressure of at least 2 t/cm$^2$ to achieve significantly lower porosity which promotes heat transfer in the agglomerates. As a result, the sintering of reduced metal proceeds efficiently in the overall regions of the agglomerates to produce a reduced metal having high strength. The reduced iron does not powder on impact when, for example, discharged from the rotary hearth furnace with a discharger. This eliminates the above problems of reoxidation and floating over a slag layer to remain undissolved in a melting furnace.

Reduced metal may also be produced by mixing a carbonaceous material made of a high-VM coal containing 35% or more by mass of volatile matter and a raw material to be reduced that contains a metal oxide; briquetting the mixture at 2 t or more per length of the pressure roll (cm) to form agglomerates with the carbonaceous material incorporated therein; and heating the agglomerates with the carbonaceous material incorporated therein in a rotary hearth furnace to reduce the agglomerates at high temperature.

When a high-pressure roll press is used, for example, the mixture may be briquetted at 2 t or more per length of the pressure roll (cm) to provide agglomerates with the carbonaceous material incorporated therein that have significantly lower porosity, high density, uniformity in particle shape, and the required strength after the high-temperature reduction. The mixture may also be briquetted into other shapes suitable for a melting step, such as almonds and pillows. To be exact, the pressure applied to each briquette varies with the rotational speed of the pressure roll, though the pressure on the briquette may be typified by the pressure per roll length at a normal roll rotational speed (2 to 30 rpm) in the operation of a briquetting machine.

The raw material to be reduced may contain a metal oxide such as iron oxide, nickel oxide, chromium oxide, manganese oxide, or titanium oxide.

Steel mill wastes, including blast furnace dust and converter dust, containing a metal such as iron or nickel may be formed into agglomerates with a carbonaceous material incorporated therein. This allows the recycling of resources. In the case of a raw material containing titanium oxide, other oxides, such as iron oxide, contained as impurities in the raw material are reduced into reduced metals such as elemental iron. When the reduced metals are fed into, for example, a melting furnace, titanium oxide, which is not reduced, separates as slag from the reduced metals so that a high concentration of titanium oxide and the reduced metals can be separately recovered. Titanium oxide and the reduced metals may also be separated after heating and melting treatment and coagulation treatment described later, rather than in the melting furnace. After these treatments, the reduced metals are formed into nuggets, which may be pulverized to separate the reduced metals and titanium oxide.

The reduced metal preferably contains 1% by mass or more of residual carbon. Unreduced metal oxide remains in the reduced metal discharged from the rotary hearth furnace after the high-temperature reduction. The residual carbon contained in the reduced metal reduces the unreduced metal oxide in a melting furnace in a downstream step. In general, if the residual carbon content of the reduced iron is less than 1% by mass, the unreduced metal oxide may be insufficiently reduced. The residual carbon content may be adjusted by changing the mixing ratio between the metal oxide and the carbonaceous material according to the volatile matter content and fixed carbon content of the carbonaceous material.

The carbonaceous material mixed with the raw material to be reduced is preferably partially or completely unheated.

The above heating refers to high-temperature heating treatment for carbonizing the carbonaceous material at about 400° C. to 1,000° C. Without such heating treatment, agglomerates with unhardened carbonaceous material incorporated therein can be formed to achieve significantly lower porosity, higher density, and thus the required strength. Though the temperature conditions of the above heating treatment vary depending on the type of carbonaceous material, heating at about 200° C. or less in the steps of pulverizing and drying the carbonaceous material is not assumed as the above heating treatment. Such heating simply for drying is acceptable because it causes substantially no effect of carbonization and hardening.

The reduced metal produced by either of the above processes is preferably further heated and melted.

The reduced metal may be heated and melted to separate slag and metal components contained in the feedstocks, namely the carbonaceous material and the raw material to be reduced. This separation provides a reduced metal having a minimized unnecessary slag content. The heating and melting temperature reduction in the rotary hearth furnace.

The reduced metal melted by the above heating and melting treatment may be caused to coagulate into nuggets.

Because the above reduced metal is produced from the mixture of the pulverized carbonaceous material and metal oxide, fine reduced metal particles are dispersed in the agglomerates. The molten reduced metal particles coagulate to form reduced metal nuggets by their own surface tension in a cooling step. Such reduced metal nuggets provide higher handling properties in, for example, carriage and charge into a melting furnace. The molten reduced metal may be cooled by, for example, carrying it to a region that is not heated by, for example, a burner on the discharger side in the rotary hearth furnace, or in a cooling region where cooling means such as a water-cooled jacket is provided on, for example, the ceiling of the furnace.

Agglomerates with a carbonaceous material incorporated therein according to the present invention are made of a carbonaceous material and a raw material to be reduced that contains a metal oxide. The carbonaceous material used is a high-VM coal containing 35% or more by mass of volatile matter. The agglomerates are formed under pressure so that the porosity thereof can be reduced to 35% or less.

As described above, agglomerates with a high-VM coal containing 35% or more by mass of volatile matter incorporated therein may be formed under pressure to reduce the porosity of the agglomerates to about 35% or less. The reduction in porosity promotes heat transfer inside the agglomerates in a high-temperature reduction step so that the sintering of reduced metal proceeds efficiently in the overall regions of the agglomerates to produce a reduced metal having high crushing strength.

BEST MODE FOR CARRYING OUT THE INVENTION

Figure 1:
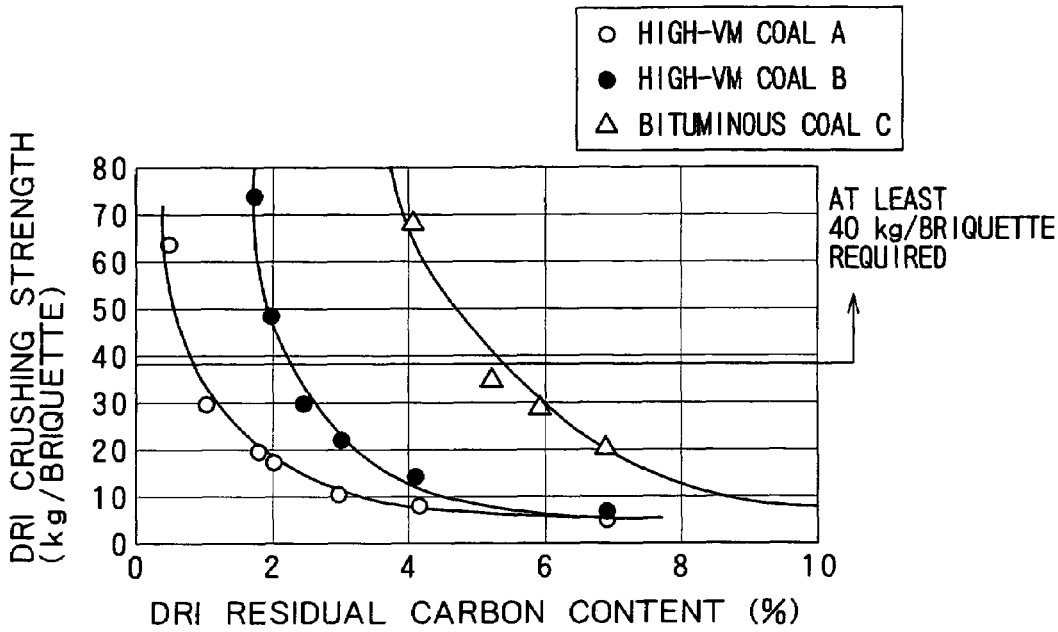
FIG. 1 is a graph showing the effect of the type of carbonaceous material on the relationship between the residual carbon content and crushing strength of reduced iron according to an example of the present invention.

In the present invention, a high-VM coal containing 35% by mass or more of volatile matter is used as a carbonaceous material. The high-VM coal and iron ore, namely metal oxide, are pulverized with a pulverizer or a grinding mill and are mixed with a mixer in such amounts that the residual carbon content after reduction is 1% by mass or more, preferably 2% by mass or more. This mixture is supplied between, for example, a pair of rolls of a high-pressure roll press. The pair of rolls have pockets formed on the surfaces thereof as matrices for forming agglomerates. The mixture of the iron ore and the high-VM coal is compressed at the required pressure, namely 2 t or more per roll length (cm) of the high-pressure roll press, preferably 3 t/cm or more, to prepare briquettes having a porosity of about 35% or less.

The agglomerates with the carbonaceous material incorporated therein are generally charged into a rotary hearth furnace that is heated with a burner, and are reduced by heating at high temperature, namely about 1,300° C., to produce reduced iron. The reduced iron is then discharged from the rotary hearth furnace and is melted by heating in an electric furnace or a melting furnace using fossil fuel to produce pig iron.

The agglomerates with the carbonaceous material incorporated therein are made of the mixture of the pulverized carbonaceous material and iron ore. When the agglomerates are reduced at high temperature, the reduced iron is produced in the form of fine particles dispersed in the briquettes. After the completion of the high-temperature reduction, the briquettes may be successively heated in the rotary hearth furnace to melt the resultant reduced iron. The melting allows the separation of slag and metal components contained in the feedstocks, namely the carbonaceous material and the iron ore, which is the raw material to be reduced, to provide a reduced iron having a minimized unnecessary slag content.

In addition, the molten reduced iron may be cooled in a region that is not heated by, for example, a burner on the discharger side in the rotary hearth furnace or in a cooling region where cooling means such as a water-cooled jacket is provided on the ceiling of the furnace. This cooling allows the molten reduced iron to coagulate into nuggets by its own surface tension.

The porosity of the agglomerates with the carbonaceous material incorporated therein is reduced by the compression molding before the high-temperature reduction, as described above, and is further reduced by the above heating and melting treatment and coagulation treatment. Subsequently, the metallized reduced iron is melted in, for example, an electric furnace. Because the reduced iron has low porosity, the adjacent reduced iron particles combine and coagulate readily to form large iron nuggets. Formation of larger iron nuggets results in a smaller amount of fine reduced iron particles that are difficult to recover because they are dispersed in slag or are excessively fine after the discharge from the rotary hearth furnace. This promotes the separation of elemental iron and slag and reduces the loss of iron to achieve a higher yield.

If the carbonaceous material has fluidity, the porosity of the agglomerates with the carbonaceous material incorporated therein may be reduced by the compression molding to allow the carbonaceous material to combine the iron ore particles more closely in the high-temperature reduction step. The close combination increases the rate of heat transfer inside the agglomerates to provide a higher reduction rate, and promotes the coagulation of the reduced iron particles by sintering even in the solid phase to facilitate the coagulation into nuggets after the above heating and melting treatment.

The reduced iron product is not limited to a general reduced iron sponge; it may also be provided in the form of powder, nuggets, or a sheet. In addition, the product may be provided in the form of molten metal or solid metal solidified after melting. The metal oxide is not necessarily limited to iron ore, and accordingly the reduced metal is not limited to reduced iron.

If a raw material containing titanium oxide is reduced, metal oxides, such as iron oxide, contained as impurities are reduced to form reduced metals such as reduced iron. When the reduced metals are fed into, for example, a melting furnace, titanium oxide, which is not reduced, separates as slag from the reduced metals so that a high concentration of titanium oxide and the reduced metals may be separately recovered. The separation is not necessarily performed only in a melting furnace; after the above heating and melting treatment and coagulation treatment, elemental iron contained in the reduced metals is formed into nuggets, which may be pulverized to separate elemental iron and titanium oxide.

In addition, because the carbonaceous material has a high volatile matter content, an excess of volatile matter may be recovered and recycled for use as a fuel at a hearth site requiring fuel supply in the rotary hearth furnace to allow such energy saving as to eliminate the need for the original fuel.

EXAMPLES

The present invention will be specifically described with examples below, though they do not limit the present invention; proper modifications are permitted within the scope compatible with the spirit described above and below, and they are all included in the technical scope of the present invention. In the description below, "%" refers to "% by mass" unless otherwise specified.

The properties of the individual components shown in the examples below were measured by the following methods:

Ash content (%): Measured according to JIS M8812 (Japanese Industrial Standards "Coal and coke—Methods for proximate analysis").

Volatile matter content (%): As above.

Fixed carbon content (%): Calculated by "100%−ash content (%)−volatile matter content (%)."

Maximum fluidity [log(DDPM)]: Measured by a fluidity test method according to JIS M8801 "Coal—Testing methods."

Crushing strength (kg/briquette): Measured according to ISO 4700, where briquettes were placed in the most stable orientation before compression (specifically, briquettes having a length of 28 mm, a width of 20 mm, and a maximum thickness of 11 mm were compressed in the thickness direction).

Example 1

Carbonaceous materials having compositions shown in Table 1 below (a high-VM coal A, a high-VM coal B, and a bituminous coal C) were pulverized so that about 80% or more of the particles had a size of 200 mesh or less. Also, iron ore was ground to a Blaine fineness of about 1,500 $cm^2/g$. Each carbonaceous material and the iron ore were mixed in varying ratios to provide varying residual carbon contents in direct reduced iron (namely, DRI residual carbon contents). The mixtures were compressed at 2.5 t/cm (per roll length) with a test briquetting machine including pillow-shaped pockets and having a roll diameter of 228 mm and a roll length (barrel length) of 70 mm to form pillow-shaped agglomerates (briquettes) with the carbonaceous materials incorporated therein. The agglomerates were oval in cross section, and had a length of 35 mm, a width of 25 mm, a maximum thickness of 13 mm, and a volume of 6 $cm^3$.

TABLE 1

| Composition (%) | Type of carbonaceous material | | | | |
|---|---|---|---|---|---|
| | High-VM coal A | High-VM coal B | Bituminous coal C | Carbonized coal D | Bituminous coal B |
| Ash content | 11.6 | 8.5 | 8.6 | 15.7 | 9.6 |
| Volatile matter content | 41.5 | 41.1 | 18.8 | 0.8 | 16.1 |
| Fixed carbon content | 46.9 | 50.4 | 72.6 | 82.7 | 74.3 |

TABLE 1-continued

| Composition (%) | Type of carbonaceous material | | | | |
|---|---|---|---|---|---|
| | High-VM coal A | High-VM coal B | Bituminous coal C | Carbonized coal D | Bituminous coal B |
| Maximum fluidity log (DDPM) | 0 | 0 | 1.6 | 0 | 0 |

The briquettes produced above were subjected to high-temperature reduction in a rotary hearth furnace at about 1,300° C. in a nitrogen atmosphere. FIG. 1 is a graph showing the relationship between the resultant DRI residual carbon content (%) and the crushing strength of direct reduced iron (having a length of 28 mm, a width of 20 mm, and a maximum thickness of 11 mm), namely DRI crushing strength (kg/briquette).

FIG. 1 shows that the DRI crushing strength increased as the content of any carbonaceous material used was reduced to decrease the DRI residual carbon content. In the case of the same DRI residual carbon content, the high-VM coals, namely the high-VM coal A and the high-VM coal B, had lower DRI crushing strength than the bituminous coal C. Of the two high-VM coals, the high-VM coal A had lower DRI crushing strength because it contained a lower amount of fixed carbon and thus had to be mixed in a relatively higher ratio to achieve the same DRI residual carbon content. Thus, DRI (direct reduced iron) produced using high-VM coal has lower crushing strength. If, for example, high-VM coal is used to achieve the required DRI crushing strength, namely 40 kg/briquette, the residual carbon content must be lower than that of DRI produced using bituminous coal. A low DRI residual carbon content, as described above, leads to insufficient reduction of unreduced metal oxide, namely iron oxide, in a melting furnace in a downstream step. Accordingly, a certain residual carbon content is required even if high-VM coal is used.

Next, the carbonaceous materials having the compositions shown in Table 1 above (the high-VM coal B and a carbonized coal D) and iron ore were pulverized so that about 80% of all particles had a size of about 200 mesh or less. Each carbonaceous material and the iron ore were mixed in varying ratios, and 5 g of each mixture was charged into a cylinder having an inner diameter of 20 mm and was compressed by a piston to form a cylindrical tablet having a diameter of 20 mm and a height of 6.7 to 8.8 mm. The height of the tablets differed depending on the molding pressure.

Figure 2:
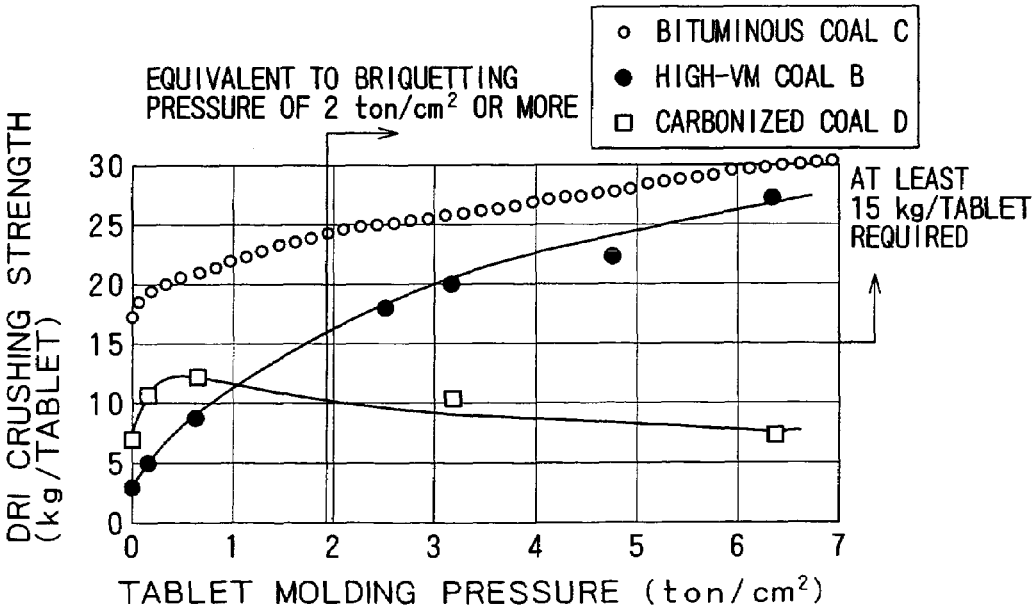
FIG. 2 is a graph showing the effect of the type of carbonaceous material on the relationship between the molding pressure of agglomerates with a carbonaceous material incorporated therein and the crushing strength of reduced iron.
Figure 3:
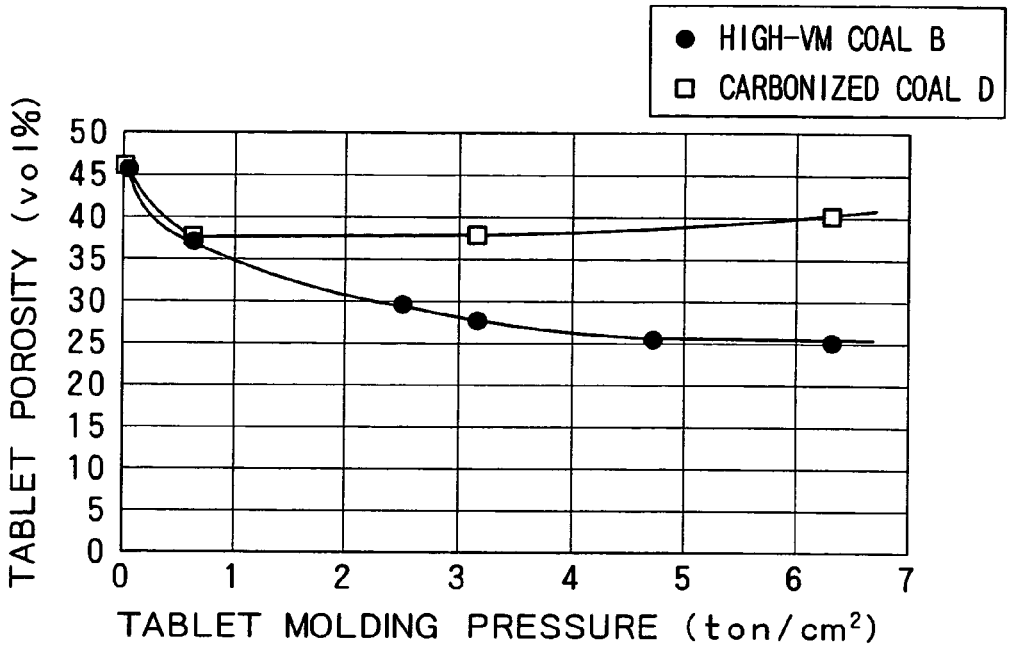
FIG. 3 is a graph showing the effect of the type of carbonaceous material on the relationship between the molding pressure and porosity of the agglomerates.
Figure 4:
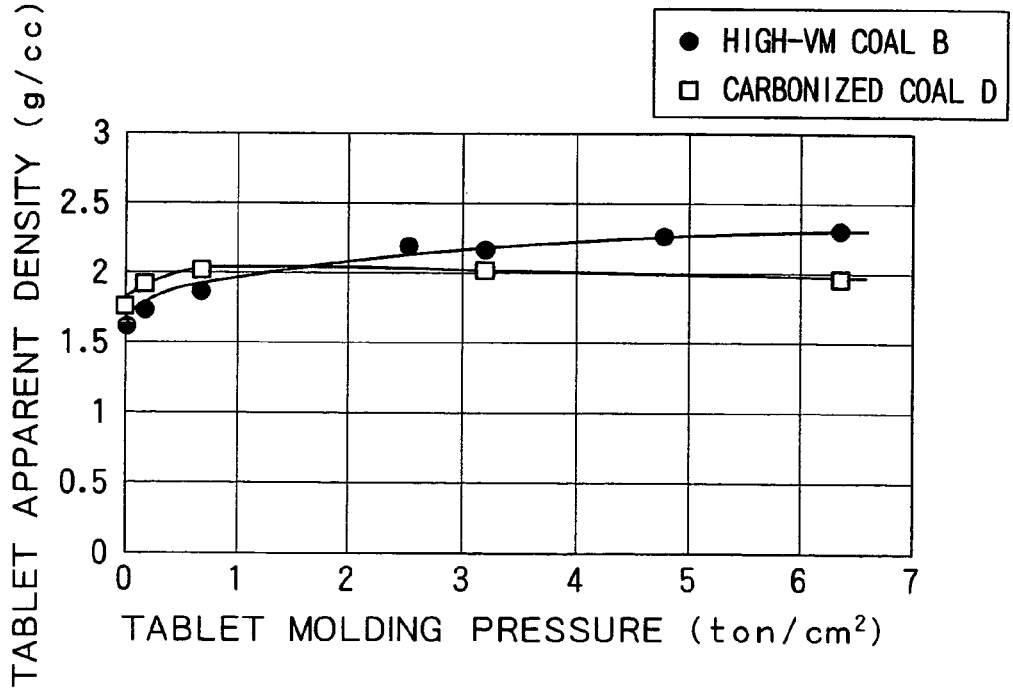
FIG. 4 is a graph showing the effect of the type of carbonaceous material on the relationship between the molding pressure and apparent density of the agglomerates.

The tablets were then subjected to high-temperature reduction by placing them in a rotary hearth furnace at about 1,300° C. for nine minutes in a nitrogen atmosphere to produce reduced iron (having a diameter of 16 to 17 mm and a height of 5.5 to 7.5 mm). FIG. 2 is a graph showing the relationship between the molding pressure on the cylindrical tablets, namely tablet molding pressure, and the crushing strength of the reduced iron, namely the DRI crushing strength (kg/tablet). FIG. 3 is a graph showing the relationship between the molding pressure on the cylindrical tablets produced using the high-VM coal B and the carbonized coal D shown in Table 1 and the porosity of the tablets. FIG. 4 is a graph showing the relationship between the tablet molding pressure and tablet apparent density ($g/cm^3$). The DRI residual carbon content was about 2%.

FIGS. 2 to 4 show that higher tablet molding pressure on the tablets produced using the high-VM coal B provided lower porosity, higher apparent density, and thus higher DRI crushing strength. The porosity and the apparent density became substantially constant at a tablet molding pressure of 5 to 6 t/cm$^2$ (490 to 588 MPa). As shown in FIG. 3, additionally, the porosity was reduced to about 35% when the tablet molding pressure was increased to about 1 t/cm$^2$ (98 MPa). Thus, when a pressure of about 1 t/cm$^2$ (98 MPa) was applied during tablet molding, the porosity was reduced from about 45%, which was the porosity in the case of substantially no pressure applied, namely 50 kg/cm$^2$ (4.9 MPa), to about 35%. That is, the amount of reduction in porosity was about half the maximum amount of reduction in porosity that could be achieved by increasing the pressure (the minimum porosity was about 25%).

According to FIG. 2, furthermore, the DRI crushing strength exceeded a usable level, namely 10 kg/tablet, at a tablet molding pressure of 1 t/cm$^2$ (98 MPa) or more, and exceeded a preferred level, namely 15 kg/tablet, at a tablet molding pressure of 2 t/cm$^2$ (196 MPa) or more, at which the amount of reduction in porosity was more than half the maximum amount of reduction in porosity. Thus, the reduction in porosity is effective in promoting heat transfer inside the tablets (agglomerates with a carbonaceous material incorporated therein) so that the sintering of reduced metal proceeds efficiently in the overall regions of the agglomerates to produce a reduced metal having high strength.

On the other hand, the bituminous coal C provided a DRI crushing strength exceeding 15 kg/tablet even at a tablet molding pressure of 1 t/cm$^2$ (98 MPa) or less because it had low porosity due to its low volatile matter content. In contrast, the carbonized coal D, which was prepared by carbonizing the high-VM coal B at about 450° C., could not achieve high DRI crushing strength by increasing the tablet molding pressure. Because the carbonization increased the hardness of the coal, the increase in tablet molding pressure did not lead to a significant decrease in porosity or an effective increase in apparent density.

When the crushing strength of a cylindrical tablet is measured according to ISO (International Standards Organization) 4700, a load is imposed on a side of the tablet. The crushing strength therefore differs depending on the length of the tablet. The volume of the tablets, or the length of the cylinders, differed slightly depending on the type of carbonaceous material because the weight of material for each tablet, namely the mixtures of the carbonaceous materials and the iron ore, was fixed to 5 g. An experiment confirmed, however, that the DRI crushing strength of the tablets produced with 5 g of raw material at a molding pressure of 1 t/cm$^2$ was nearly equivalent to the DRI crushing strength of the briquettes having a volume of 6 cm$^3$ at a molding pressure of 1 t/cm. Hence, the tablet molding pressure (t/cm$^2$), indicated by the horizontal axis of FIG. 2, may be assumed as briquetting pressure (t/cm).

Accordingly, the relationship shown in FIG. 2 may be assumed as that between the briquetting pressure (t/cm) and the DRI crushing strength (kg/tablet). Tablets produced with a briquetting machine at a briquetting pressure of 2 t/cm or more may be assumed to have a DRI crushing strength exceeding the preferred DRI crushing strength, namely 15 kg/tablet. In addition, tablets produced at a molding pressure of 3 t/cm or more may be assumed to have a DRI crushing strength exceeding 20 kg/tablet. Such a high molding pressure range is more preferable because tablets reaching the above strength range have significantly improved resistance to powdering on impact during the carriage of reduced iron.

Example 2

Figure 5:
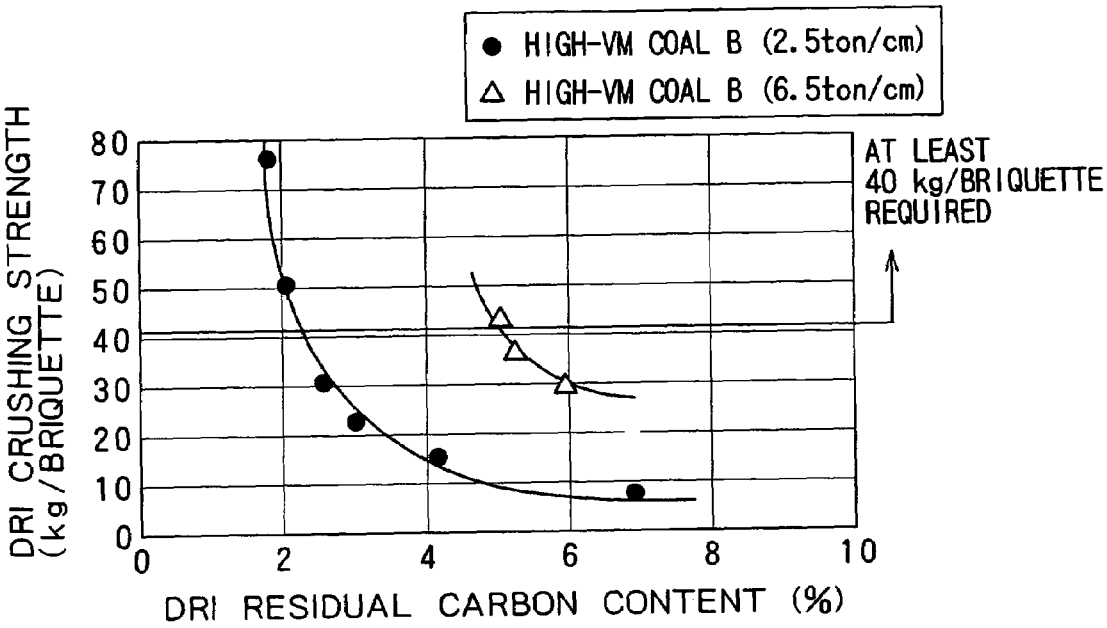
FIG. 5 is a graph showing the effect of the molding pressure on the relationship between the residual carbon content and crushing strength of reduced iron.

The high-VM coal B and the carbonized coal D shown in Example 1 were used. The high-VM coal B was used to form briquettes with the carbonaceous material incorporated therein that had volumes of 6 cm$^3$ at 2.5 t/cm and 6.5 t/cm. These briquettes were subjected to high-temperature reduction by placing them in a rotary hearth furnace at about 1,300° C. for about nine minutes in a nitrogen atmosphere. FIG. 5 is a graph showing the relationship between the DRI residual carbon content (% by mass) and the DRI crushing strength (kg/briquette). FIG. 5 shows that higher DRI crushing strength was achieved at the higher briquetting pressure, namely 6.5 t/cm, in the case of the same residual carbon content, which contributes to the reduction of unreduced metal oxide, namely iron oxide, in a melting furnace in a downstream step. This means that a reduced iron having high crushing strength can be produced with high-VM coal by increasing the briquetting pressure even if the content of the high-VM coal is increased to ensure the required DRI residual carbon content. If, for example, the high-VM coal B shown in Table 1, which contains about 41% of volatile matter and about 50% by mass of fixed carbon, is used, briquettes with the carbonaceous material incorporated therein may be formed at a briquetting pressure of 6.5 t/cm to produce a reduced iron having a DRI residual carbon content of 5% and the required DRI crushing strength, namely about 40 kg/briquette.

Higher molding pressure, however, increases the amount of roll wear of the roll press and thus raises maintenance cost. An optimum molding pressure may be determined in consideration of both the required DRI crushing strength level and production cost; a molding pressure of 2.5 to 10 t/cm is preferred.

Comparative Example

Figure 6:
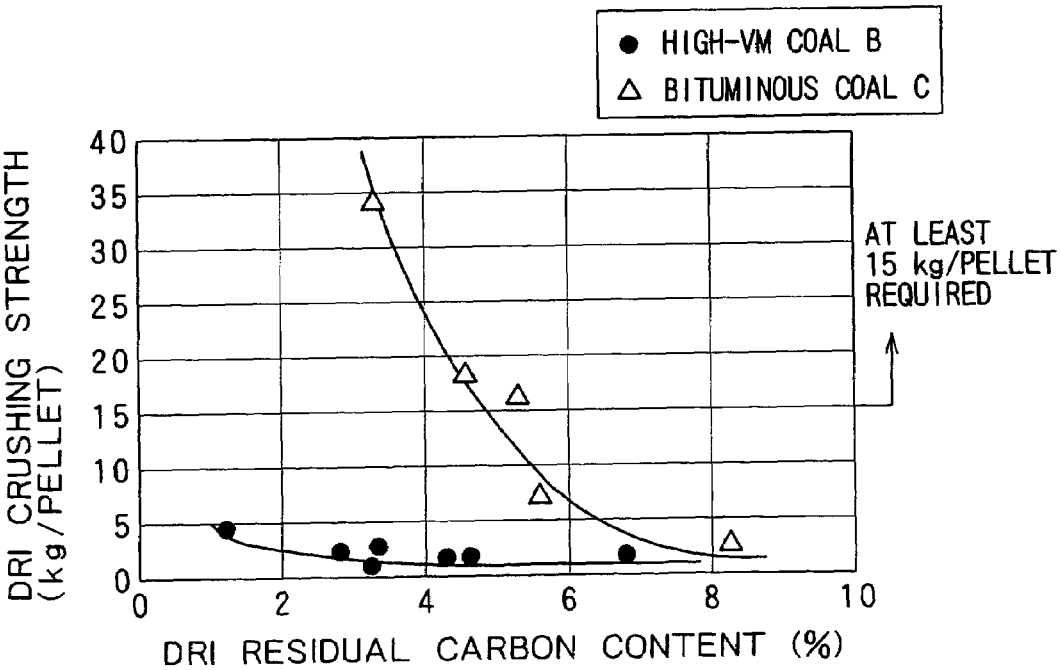
FIG. 6 is a graph showing the effect of the type of carbonaceous material on the relationship between the residual carbon content and crushing strength of reduced iron in the related art.

The carbonaceous materials having the compositions shown in Table 1 (the high-VM coal B and the bituminous coal C) and iron ore were pulverized so that about 80% of all particles had a size of about 200 mesh or less. Each carbonaceous material and the iron ore were mixed and granulated into pellets having a diameter of 17 mm with a pelletizer (granulator). These pellets were subjected to high-temperature reduction in a rotary hearth furnace at about 1,300° C. in a nitrogen atmosphere to produce reduced iron. FIG. 6 is a graph showing the relationship between the DRI residual carbon content (%) and DRI crushing strength (kg/pellet) of the reduced iron. For the bituminous coal C, which had a low volatile matter content, the DRI crushing strength increased significantly with decreasing DRI residual carbon content to exceed the required crushing strength, namely 15 kg/pellet. For the high-VM coal B, which had a high volatile matter content, the DRI crushing strength tended to increase slightly with decreasing DRI residual carbon content, but could not reach the required crushing strength, namely 15 kg/pellet, because of low compression pressure in the granulation and a small decrease in porosity.

Example 3

Briquettes with carbonaceous materials having a fluidity of zero incorporated therein were prepared and reduced in a rotary hearth furnace. Table 2 below shows the relationship between the content of oxide particles having a size of 10 μm or less in iron oxide and the crushing strength of the reduced iron and the ratio of fines of the reduced iron smaller than 6 mm. This table also shows the types of carbonaceous materials used (see Table 1 above), the contents of the carbonaceous materials and iron ore, and the metallization rate and residual carbon content of the reduced iron. The briquettes with the carbonaceous materials incorporated therein were reduced in the rotary hearth furnace under the same conditions as in Examples 1 and 2 above, namely at about 1,300° C. in a nitrogen atmosphere for about nine minutes. The carbonaceous materials used had a fluidity of zero.

TABLE 2

| | Example 1 | Example 2 | Comparative Example |
|---|---|---|---|
| Content of fine particles having size of 10 μm or less in iron oxide (% by mass) | 6.8 | 13.3 | 13.3 |
| Crushing strength of reduced iron (kg/briquette) | 52.4 | 75.5 | 33.9 |
| Ratio of fines of reduced iron smaller than 6 mm (% by mass) | 5.1 | 3 | 68.2 |
| Briquetting pressure (t/cm) | 2.5 | 2.5 | 0.2 |
| Briquette porosity (%) | 30 | 26 | 41 |
| Type of carbonaceous material | High-VM coal B | High-VM coal B | Bituminous coal E |
| Content of iron ore (% by mass) | 72.5 | 72.5 | 78 |
| Content of carbonaceous material (% by mass) | 27.5 | 27.5 | 22 |
| Metallization rate of reduced iron (% by mass) | 98.1 | 99.1 | 98.3 |
| Residual carbon content of reduced iron (% by mass) | 1.95 | 1.84 | 1.91 |

According to the known art, as described above, if a coal having a fluidity of zero is used, 15% by mass or more of iron oxide particles having a size of 10 μm or less are required to reduce the ratio of fines of the reduced iron smaller than 6 mm to a practically acceptable level, namely 10% by mass or less. For either example with a briquetting pressure of 2.5 t/cm, the content of iron oxide particles having a size of 10 μm or less was less than 15%, and the ratio of fines was less than 10%. In addition, the porosity was less than 35%, and the DRI crushing strength exceeded the required level, namely 40 kg/briquette. For the comparative example with a low briquetting pressure, namely 0.2 t/cm, the content of iron oxide particles having a size of 10 μm or less was less than 15%, and thus the ratio of fines was extremely high, namely about 68%. In addition, the porosity exceeded 40%, and the DRI crushing strength was about 34 kg/briquette, which is below the required level, namely 40 kg/briquette.

As described above, the raw material to be reduced may also be, for example, nickel oxide, chromium oxide, or manganese oxide. In addition, a raw material containing a heavy metal such as zinc oxide or lead oxide may be reduced, though the heavy metal should be recovered at high concentration with a bag filter since it volatilizes when reduced.

INDUSTRIAL APPLICABILITY

According to the present invention, as described above, agglomerates with a carbonaceous material incorporated therein are formed using a high-VM coal containing 35% or more of volatile matter at a pressure of at least 2 t/cm$^2$ to achieve significantly lower porosity. This promotes heat transfer inside the agglomerates in a rotary hearth furnace in a high-temperature reduction step so that the sintering of reduced metal proceeds efficiently in the overall regions of the agglomerates to produce a reduced metal having high crushing strength. Such a reduced metal having high crushing strength may be produced even if a carbonaceous material with no fluidity is used or the content of the high-VM coal is increased to ensure the required residual carbon content. The reduced iron does not powder when discharged from the rotary hearth furnace, thus eliminating the problems of reoxidation and floating over a slag layer to remain undissolved in a melting furnace.

Accordingly, high-strength reduced iron can be produced using high-VM coal, which contains a large amount of volatile matter, is widely and abundantly distributed on the earth, and is less expensive. The reduced iron may be used effectively as pig iron for producing steel and ferroalloy or as a prereducing material for charge with scrap in the production of ferroalloy.

The invention claimed is:

1. A process for producing reduced metal, comprising forming a mixture comprising a carbonaceous material and at least one metal oxide, but excluding liquid hydrocarbon, where the carbonaceous material comprises a high-VM coal containing 35% or more by mass of volatile matter;

molding the mixture at 2 t/cm$^2$ or more to form agglomerates with the carbonaceous material incorporated therein and having a porosity of 35% or less; and heating the agglomerates with the carbonaceous material incorporated therein in a rotary hearth furnace to reduce the agglomerates at high temperature.

2. The process for producing reduced metal according to claim 1, wherein the at least one metal oxide is selected from the group consisting of iron oxide, nickel oxide, chromium oxide, manganese oxide and titanium oxide.

3. The process for producing reduced metal according to claim 1, wherein the reduced metal contains 1% by mass or more of residual carbon.

4. The process for producing reduced metal according to claim 1, wherein during the forming of the mixture the carbonaceous material that is mixed with the at least one metal oxide is partially or completely unheated.

5. A process for producing reduced metal, comprising heating and melting the reduced metal produced by the process according to claim 1.

6. A process for producing reduced metal, comprising causing the reduced metal melted by the heating and melting treatment according to claim 5 to coagulate into nuggets.

7. The process for producing reduced metal according to claim 1, wherein the mixture consists of the carbonaceous material and the at least one metal oxide; and the carbonaceous material consists of the high-VM coal containing 35% or more by mass of volatile matter.

8. A process for producing reduced metal, comprising forming a mixture comprising a carbonaceous material and at least one metal oxide, but excluding liquid hydrocarbon, where the carbonaceous material comprises a high-VM coal containing 35% or more by mass of volatile matter;

briquetting the mixture at 2 t/cm or more per length of the briquetting roll (cm) to form agglomerates with the carbonaceous material incorporated therein and having a porosity of 35% or less; and heating the agglomerates with the carbonaceous material incorporated therein in a rotary hearth furnace to reduce the agglomerates at high temperature.

9. The process for producing reduced metal according to claim 8, wherein the at least one metal oxide is selected from the group consisting of iron oxide, nickel oxide, chromium oxide, manganese oxide and titanium oxide.

10. The process for producing reduced metal according to claim 8, wherein the reduced metal contains 1% by mass or more of residual carbon.

11. The process for producing reduced metal according to claim 8, wherein during the forming of the mixture the carbonaceous material that is mixed with the at least one metal oxide is partially or completely unheated.

12. A process for producing reduced metal, comprising heating and melting the reduced metal produced by the process according to claim 8.

13. A process for producing reduced metal, comprising causing the reduced metal melted by the heating and melting treatment according to claim 12 to coagulate into nuggets.

14. The process for producing reduced metal according to claim 8, wherein the mixture consists of the carbonaceous material and the at least one metal oxide; and the carbonaceous material consists of the high-VM coal containing 35% or more by mass of volatile matter.

15. Agglomerates with a carbonaceous material incorporated therein, wherein the agglomerates comprise the carbonaceous material and at least one metal oxide, but exclude liquid hydrocarbon, the carbonaceous material comprises a high-VM coal containing 35% or more by mass of volatile matter, and the agglomerates are formed under pressure at 2 t/cm$^2$ or more so that the porosity thereof is reduced to 35% or less.

16. The agglomerates according to claim 15, wherein the agglomerates consist of the carbonaceous material and the at least one metal oxide; and the carbonaceous material consists of the high-VM coal containing 35% or more by mass of volatile matter.

17. Agglomerates with a carbonaceous material incorporated therein, wherein the agglomerates comprise the carbonaceous material and at least one metal oxide, but exclude liquid hydrocarbon, the carbonaceous material comprises a high-VM coal containing 35% or more by mass of volatile matter, and the agglomerates are formed by briquetting under pressure at 2 t/cm or more per length of the briquetting roll (cm) so that the porosity of the agglomerates is reduced to 35% or less.

18. The agglomerates according to claim 17, wherein the agglomerates consist of the carbonaceous material and the at least one metal oxide; and the carbonaceous material consists of the high-VM coal containing 35% or more by mass of volatile matter.

* * * * *